US005335766A

United States Patent [19]

Rizzoli et al.

[11] Patent Number: 5,335,766

[45] Date of Patent: Aug. 9, 1994

[54] DEVICE FOR FEEDING FILTERS TO A FILTER ASSEMBLY MACHINE

[75] Inventors: Salvatore Rizzoli, Bologna; Bruno Belvederi, S. Martino di Monte S. Pietro, both of Italy

[73] Assignee: G.D Societa' Per Azioni, Bologna, Italy

[21] Appl. No.: 915,943

[22] Filed: Jul. 17, 1992

[30] Foreign Application Priority Data

Jul. 19, 1991 [IT] Italy ..... B091A 000267

[51] Int. Cl.[5] ..... B65G 37/00

[52] U.S. Cl. ..... 198/347.1; 131/94

[58] Field of Search ..... 198/347.1; 131/94, 282, 131/283

[56] References Cited

U.S. PATENT DOCUMENTS 4,372,710 2/1983 Kasparek et al. ..... 406/28
4,551,040 11/1985 Kasparek et al. ..... 406/28
4,595,025 6/1986 Wahle et al. ..... 131/94
4,790,333 12/1988 Focke et al. ..... 198/347.1
4,903,712 2/1990 Strydom ..... 131/94 X

FOREIGN PATENT DOCUMENTS 2164376 7/1973 France .
768592 2/1957 United Kingdom ..... 131/94

*Primary Examiner*—Cheryl L. Gastineau
*Attorney, Agent, or Firm*—Marshall, O'Toole, Gerstein, Murray & Borun

[57] ABSTRACT

A device for feeding filter portions to a filter assembly machine, wherein an input feedbox, defined by two facing lateral walls arranged parallel and separated by a distance at least equal to the length of the filter portions, is fed with the filter portions along a conduit by which the filter portions are fed axially into an eccentric lateral groove in an elongated body fitted through the feedbox and rotating about its axis perpendicular to the lateral walls of the feedbox.

7 Claims, 4 Drawing Sheets

DEVICE FOR FEEDING FILTERS TO A FILTER ASSEMBLY MACHINE

BACKGROUND OF THE INVENTION

The present invention relates to a device for feeding filters to a filter assembly machine.

On known filter assembly machines, such as those described in U.S. Pat. Nos. 4,551,040; 4,372,710; and 4,595,025, corresponding respectively to British Patents n. 2,059,901, 2,060,535 and 2,132,871, the filters are normally produced in the form of a continuous rod, which is fed longitudinally through a cutting head by which it is cut into portions of a length equal to a multiple of that of a single cigarette filter. The cut lengths are then arrested and fed transversely into the input feedbox of the filter assembly machine.

At the bottom of the feedbox, the filter portions are withdrawn and fed transversely, on a wheel with peripheral seats, to a further cutting station where they are cut transversely into double filters, i.e. filter portions twice as long as a single cigarette filter.

On filter assembly machines of the aforementioned type, the manner in which the filter portions cut from the continuous rod are fed to the feedbox involves a number of drawbacks limiting the maximum operating speed of the machine.

This is due to the fact that, over and above a given operating speed of the machine, the stress produced by arresting and changing the traveling direction of the filter portions may be such as to result in damage to the same.

Moreover, stopping and changing the traveling direction of the filter portions involves the use of numerous actuating and control members, which not only complicate the design but also impair the reliability of the machine.

SUMMARY OF THE INVENTION

It is an object of the present invention to provide a device for feeding filters to a filter assembly machine, designed to overcome the aforementioned drawbacks.

According to the present invention, there is provided a device for feeding filters to a filter assembly machine, said device comprising a feedbox having two facing lateral walls arranged parallel and at a given distance from each other; and conveying means for feeding filter portions, of a length at most equal to said distance, into and perpendicular to the walls of said feedbox; characterized by the fact that said conveying means comprise at least an elongated body fitted through the feedbox, and rotating about its axis perpendicular to said lateral walls; a supply conduit for said filter portions, connected to said elongated body; passage means formed in said elongated body, for enabling said conduit to communicate internally with said feedbox; push means for axially feeding said filter portions along said conduit and said passage means; and actuating means for rotating said elongated body and said conduit about said axis.

According to a preferred embodiment of the above device, the elongated body presents a cylindrically spiral outer surface, wherein two generating lines, respectively closer to and further from said axis, are connected by a substantially flat surface arranged substantially radially in relation to said axis and facing rearwards in relation to the direction in which the elongated body is rotated by said actuating means; said passage means opening on to said flat connecting surface in a direction substantially parallel to said axis.

Said passage means preferably comprise a groove formed on said flat surface, communicating axially at one end with said conduit, and having a diameter at least equal to that of said filter portions.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 1A:
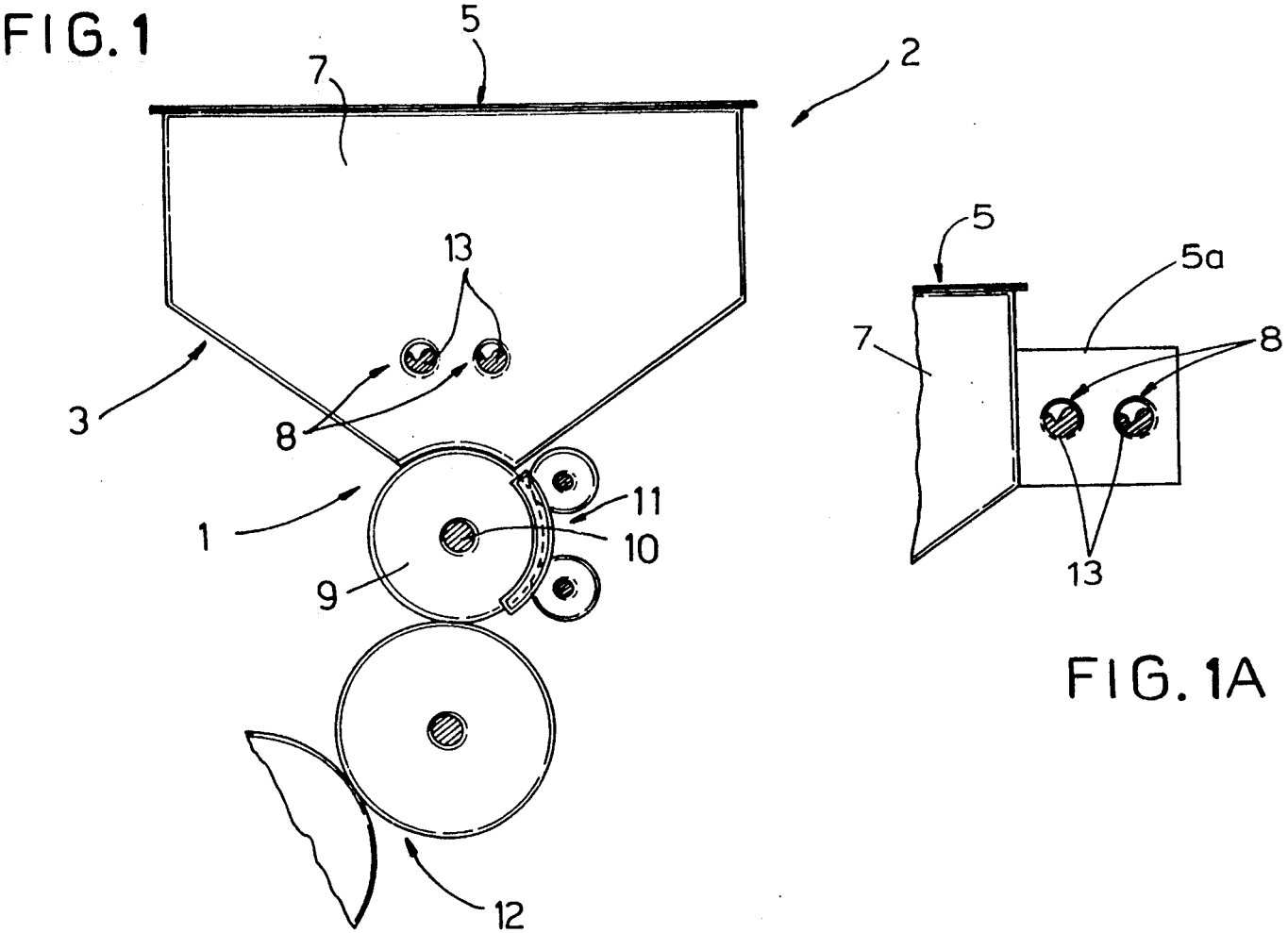
FIG. 1 shows a schematic, partially sectioned side view, with parts removed for clarity, of the input portion of a filter assembly machine featuring a device in accordance with the teachings of the present invention.
FIG. 1A shows a schematic, fragmented side view of an alternative embodiment of the invention.

Number 1 in FIG. 1 indicates the input portion or unit of a filter assembly machine 2.

Unit 1 comprises a device 3 for supplying machine 2 with filter portions 4 (FIG. 3) cut transversely in known manner from a continuous filter rod (not shown). Device 3 comprises a feedbox 5 having two facing lateral walls 6 and 7 arranged parallel and separated by a distance equal to or greater than the length of filter portions 4.

In the example shown, feedbox 5 is input-connected to two conveying devices 8 (one of which is dispensable) for successively feeding filter portions 4 into feedbox 5. As shown by the continuous line in FIG. 1, if provision is made for purely continuous flow of filter portions 4 to feedbox 5, conveying devices 8, by which this is effected, are connected to a central portion of feedbox 5. Conversely, if provision is made for mixed flow of filter portions 4 to feedbox 5, i.e. by means of boxes to the side of said continuous flow, feedbox 5 preferably presents a lateral compartment 5*a* (shown in FIG. 1A) inside which conveying devices 8 terminate.

The output of feedbox 5 cooperates in known manner with the periphery of a roller 9 fitted on to a drive shaft 10 perpendicular to walls 6 and 7, and having a number of peripheral axial seats (not shown) for receiving respective filter portions 4. Roller 9 provides for successively feeding filter portions 4, transversely in relation to their longitudinal axis, through a cutting station 11, where each is cut transversely into a given number (usually three) of double filters (not shown), i.e. twice as long as a normal cigarette filter, before being fed by a series of rollers 12 to follow-up user equipment (not shown).

Figure 2:
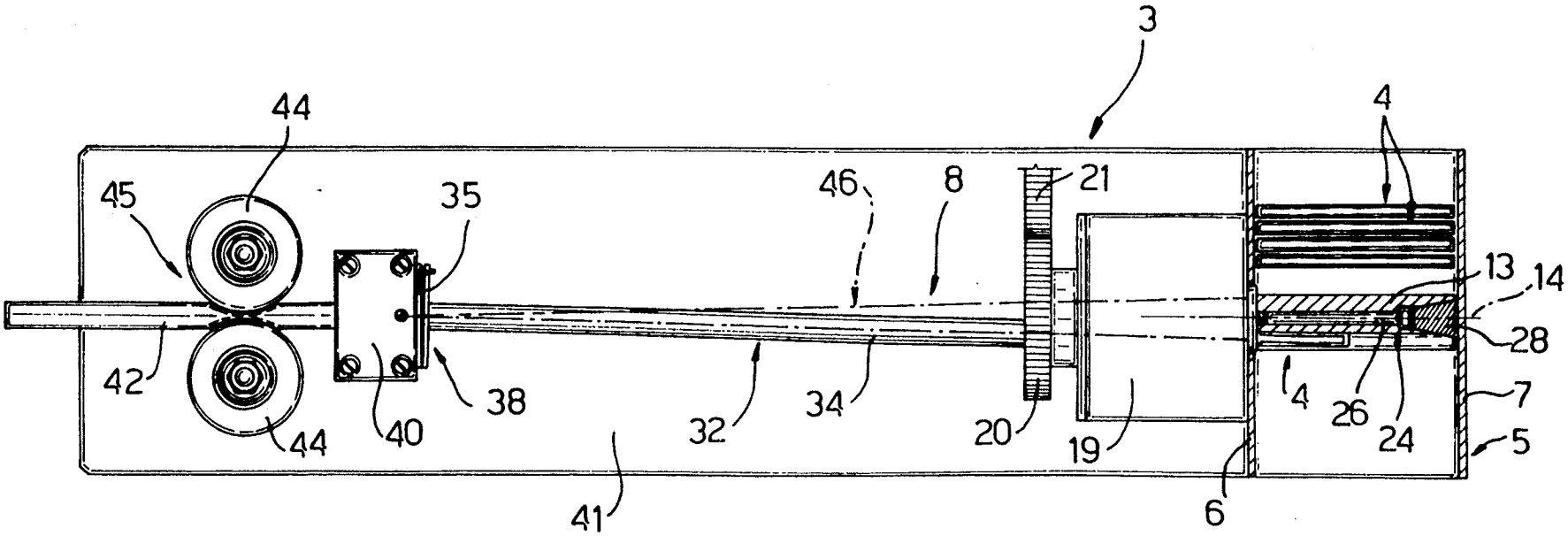
FIG. 2 shows an enlarged, partially sectioned side view, with parts removed for clarity, of the FIG. 1 device.
Figure 3:
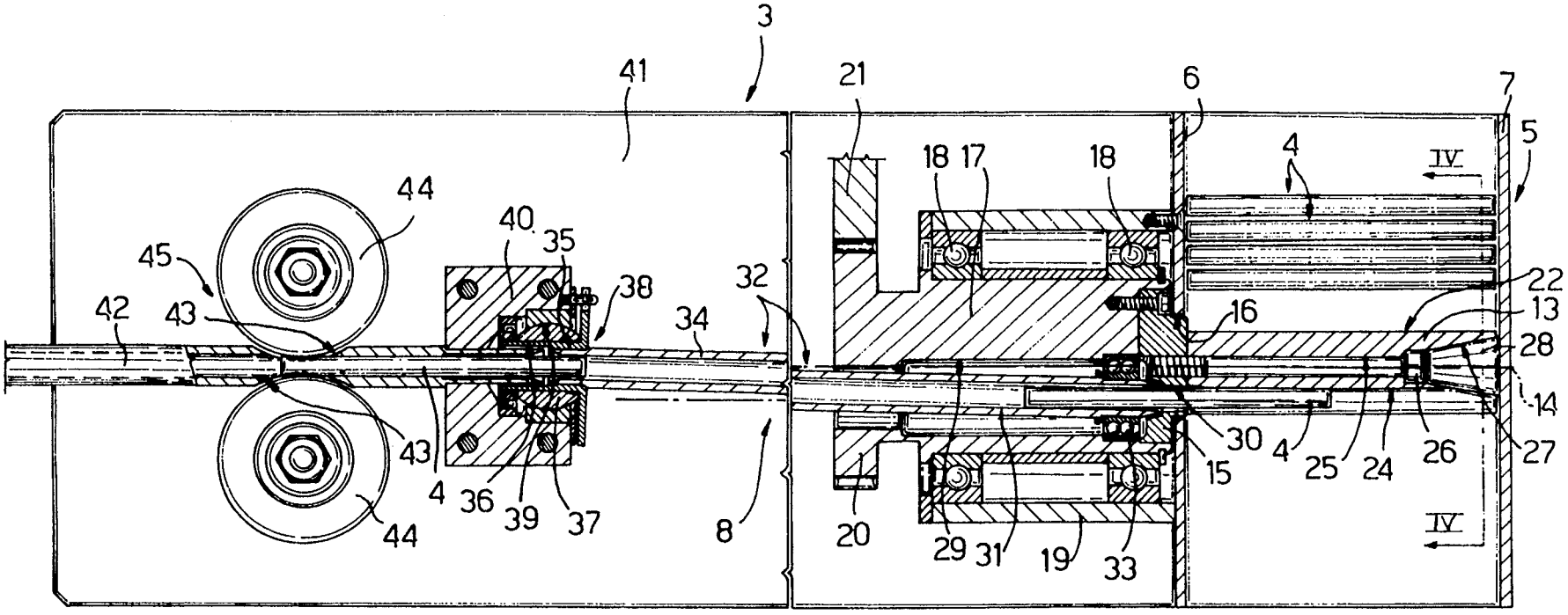
FIG. 3 shows an enlarged longitudinal section of the FIG. 2 device.

As shown in FIG. 2 and particularly in FIG. 3, each conveying device 8 comprises an elongated body 13 extending between, and along an axis 14 perpendicular to, walls 6 and 7, and having a cylindrical base 15 extending for rotation through a circular hole 16 formed through wall 6 and coaxial with axis 14. The end of base 15 outside feedbox 5 is connected integral with an axial end of a substantially cylindrical drum 17 coaxial with axis 14 and mounted for rotation, via the interposition of bearings 18, inside a cylindrical bush 19 coaxial with axis 14 and connected integral with wall 6, which thus supports both drum 17 and elongated body 13.

The end of drum 17 opposite that connected to base 15 is fitted integral with a gear 20 coaxial with axis 14 and meshing with a drive gear 21 for rotating drum 17 and body 13 anticlockwise (in FIG. 4) and at a given angular speed about axis 14.

Figure 4:
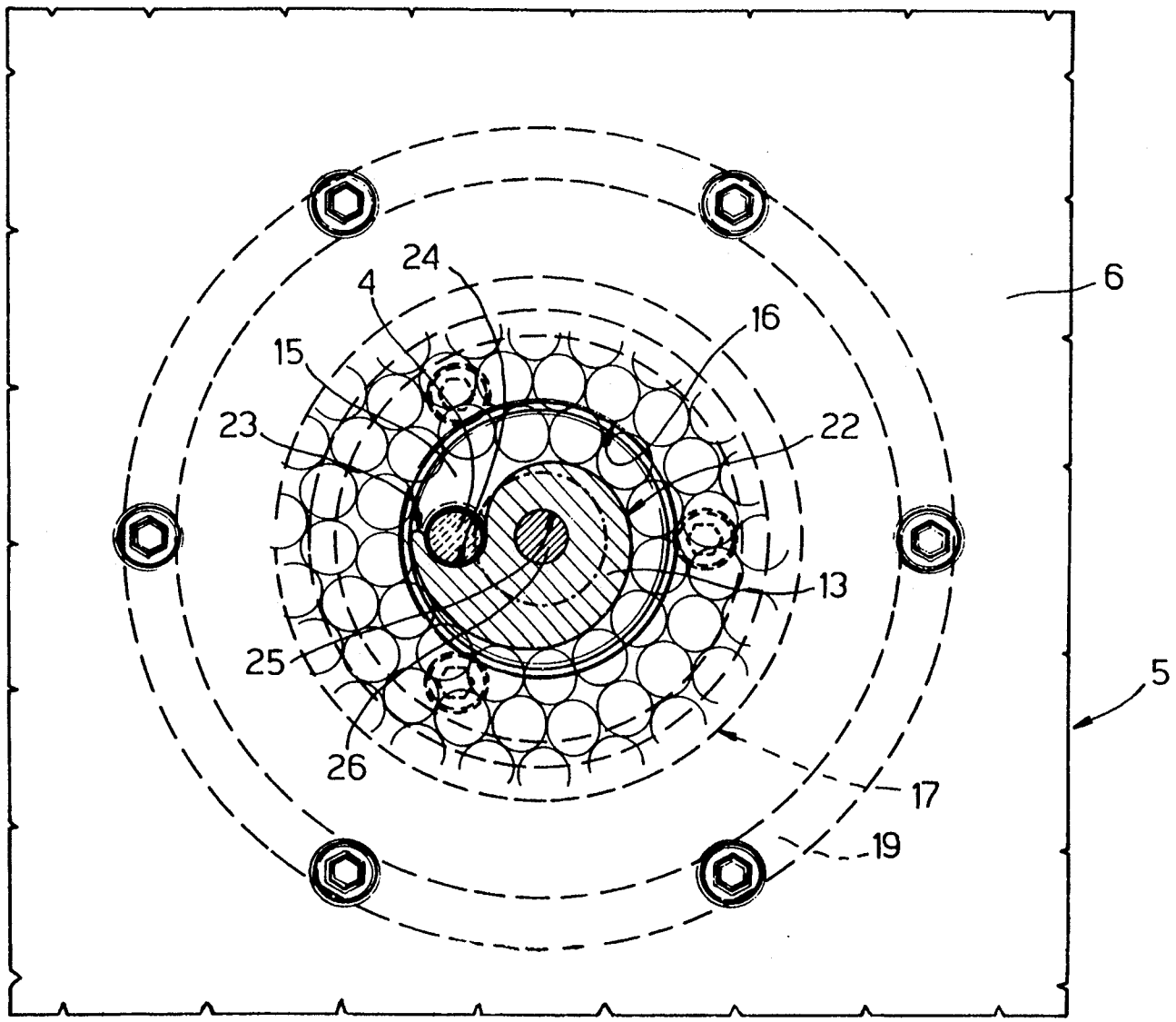
FIG. 4 shows a section along line IV—IV in FIG. 3.

As shown in FIG. 4, body 13 presents an outer surface 22 in the form of a cylindrical spiral, a first and second generating line of which, respectively closest to and furthest from axis 14, are connected by a surface 23 arranged substantially radially in relation to axis 14, facing rearwards (FIG. 4) in relation to the rotation direction of body 13, and having an axial, substantially semicircular-section groove 24 parallel to axis 14 and having a diameter equal to or greater than that of filter portions 4.

Body 13 is substantially equal in length to the distance between walls 6 and 7, and presents an axial hole 25 coaxial with axis 14 and engaged by a screw 26 for connecting body 13 to base 15. The end portion 27 of hole 25 facing wall 7 is truncated-cone-shaped, tapering towards wall 6 and intersecting an end portion of groove 24, and is engaged by a truncated-cone-shaped plug 28 partially engaging an end portion of groove 24 for the reasons described in detail later on.

As shown in FIG. 3, drum 17 presents an eccentric longitudinal hole 29 coaxial with a hole 30 formed through base 15 and coaxial with groove 24, which hole 29 is engaged in relatively radially slack manner by the end portion 31 of a conduit 32 for axially feeding filter portions 4 to feedbox 5. End portion 31 presents a free end connected to and communicating with hole 30, and engages the inner ring of a bearing 33 located between end portion 31 and the inner surface of hole 29.

Conduit 32 also comprises an intermediate portion 34 having a first end connected integral with end portion 31, and a second end, opposite the first, engaging a tubular element 35. Tubular element 35 is engaged inside a diametrical hole 36 in the ball 37 of a spherical joint 38, the spherical seat 39 of which is formed inside a body 40 connected integral with a plate 41 supporting feedbox 5.

Hole 36 and tubular element 35 are engaged by the output end of an input portion 42 of conduit 32. Input portion 42 is fitted in a fixed position to plate 41, and extends, on the opposite side to that connected to joint 38, through a cutting station (not shown) where a continuous filter red (not shown) is cut transversely into filter portions 4, which are fed successively along input portion 42. For feeding filter portions 4 rapidly along at least the final portion of conduit 32, and at intervals to groove 24, input portion 42 of conduit 32 presents two diametrically-opposed axial recesses 43 engaged by outer peripheral portions of respective counter-rotating rollers 44 of a push device 45.

In actual use, rotation of drum 17 at substantially constant angular speed is accompanied by rotation of body 13 at the same speed about axis 14, and translation of intermediate portion 34 and end portion 31 of conduit 32 along a cone 46 (FIG. 2), the tip of which is located in the center of ball 37 of joint 38, and the base of which, at hole 30, presents a radius equal to the distance between the axis of hole 30 and axis 14.

Rotation of body 13 inside the mass of filter portions 4 inside feedbox 5 results in portions 4 on surface 22 gradually being spun away from axis 14, and, as shown in FIG. 4, in the formation of a gap behind surface 23 and groove 24, which may thus be fed successively, via push device 45 and conduit 32, with filter portions 4 fed directly off a continuous filter rod machine (not shown), and which are fed along conduit 32 and axially, with no stoppage and/or change in direction, straight into groove 24 through hole 30.

The specific function of push device 45 is to accelerate portions 4 so as to form a gap between one portion 4 and the next.

On reaching groove 24, each portion 4 proceeds by force of inertia along groove 24 so as to gradually engage the conical outer surface of plug 28, which provides for braking and so preventing portion 4 from being damaged by impact with wall 7. Plug 28 also acts as an ejector by cooperating with the centrifugal forces involved, for laterally ejecting portions 4 from groove 24 and into the gap formed by the rotation of body 13 inside the mass of portions 4 between walls 6 and 7 of feedbox 5.

We claim:

1. A device (3) for feeding filters to a filter assembly machine (2), said device (3) comprising a feedbox (5) having two facing lateral walls (6, 7) arranged parallel and at a given distance from each other; and conveying means (8) for feeding filter portions (4), of a length at most equal to said distance, into and perpendicular to the walls (6, 7) of said feedbox (5); characterized by the fact that said conveying means (8) comprise at least an elongated body (13) fitted through the feedbox (5), and rotating abut its axis (14) perpendicular to said lateral walls (6, 7); a supply conduit (32) for said filter portions (4), connected to said elongated body (13); passage means (24) formed in said elongated body (13), for enabling said conduit (32) to communicate internally with said feedbox (5); push means (45) for axially feeding said filter portions (4) along said conduit (32) and said passage means (24); and actuating means (17, 20, 21) for rotating said elongated body (13) and said conduit (32) abut said axis (14).

2. A device as claimed in claim 1, characterized by the fact that said elongated body (13) presents an outer surface (22) in the form of a cylindrical spiral, wherein two generating lines, respectively closer to and further from said axis (14), are connected by a surface (23) positioned substantially radially in relation to said axis (14) and facing rearwards in relation to the direction in which said elongated body (13) is rotated by said actuating means (17, 20, 21); said passage means (24) opening on to said connecting surface (23) in a direction substantially parallel to said axis (14).

3. A device as claimed in claim 2, characterized by the fact that said passage means (24) comprise a groove formed in said surface (23) and communicating axially, at one end, with said conduit (32); said groove (24) presenting a diameter at least equal to that of said filter portions (4).

4. A device as claimed in claim 1, characterized by the fact that said actuating means (17, 20, 21) comprise a drum (17) located outside the feedbox (5) and supported on one of said walls (6, 7) so as to rotate about said axis (14); said elongated body (13) being integral and coaxial with said drum (17); and said conduit (32) comprising an end portion (31) fitted eccentrically through said drum (17) and coaxial with said passage means (24).

5. A device as claimed in claim 4, characterized by the fact that, in addition to said end portion (31), said conduit (32) for supplying said filter portions (4) also comprises a fixed input portion (42), and an intermediate portion (34) connecting the input portion (42) to the end portion (31); a spherical joint (38) being provided between said input portion (42) and said intermediate portion (34) for enabling said intermediate portion (34) and said end portion (31) to travel over a conical surface (46) having a base radius equal to the distance between said end portion (31) and said axis (14).

6. A device as claimed in claim 5, characterized by the fact that said fixed input portion (42) cooperates with said push means (45).

7. A device as claimed in claim 1, characterized by the fact that the device comprises braking means (28) cooperating with said passage means (24), for braking said filter portions (4) as they travel along said passage means (24).

* * * * *